United States Patent [19]

Zeller

[11] 3,977,674

[45] Aug. 31, 1976

[54] HOLDER FOR A GOLF BALL MARKING PLATE

[76] Inventor: Henry O. Zeller, 2083 Five Mile Line Road, Penfield, N.Y. 14526

[22] Filed: Dec. 11, 1974

[21] Appl. No.: 531,805

[52] U.S. Cl. ..... 273/32 A; 273/1 M; 273/162 D

[51] Int. Cl.[2] ..... A63B 53/14

[58] Field of Search ..... 273/32 A, 32 R, 162 D, 273/1 M; 224/5 C; 46/17; 206/.82, .83; 40/315

[56] References Cited

UNITED STATES PATENTS

| | | | |
|---|---|---|---|
| 301,292 | 7/1884 | Smith | 40/315 |
| 2,178,872 | 11/1939 | Engstrom | 273/162 D |
| 2,261,959 | 11/1941 | Buttikofer | 273/32 A |
| 2,714,269 | 8/1955 | Charles | 46/17 X |
| 2,808,925 | 10/1957 | O'Rielly | 206/.82 |
| 3,468,045 | 9/1969 | Keller et al. | 40/1.5 |

*Primary Examiner*—Richard C. Pinkham
*Assistant Examiner*—William R. Browne

[57] ABSTRACT

A holder for a golf ball marking plate or coin which is preferably mounted on the shank of a golf club such as a putter. The holder comprises a body member having a recess and lip combination on one side for releasably holding the marking plate. A recess on the opposite side of the body member conforms to the outer periphery of the putter shank and receives the shank when the holder is mounted thereon. The body member is further provided with a tape for securing the holder to the putter.

12 Claims, 9 Drawing Figures

HOLDER FOR A GOLF BALL MARKING PLATE

BACKGROUND OF THE INVENTION

1. Field of the Invention

This invention relates generally to holders, and more specifically to a holder for a golf ball marking plate.

2. Description of the Prior Art

In golfing, it is known to use a golf ball marking plate for marking the position of a ball on a golf green. This permits removal of the ball which would otherwise interfere with the putting of other golfers. It is further known in the prior art to provide a holder for such golf ball marking plates, preferably carrier by the golfer. One such holder comprises a device having a pair of spaced apart spring plates between which one or more marking plates are inserted and releasably held by the resilience of the spring plates. It is further known to provide a cloth holder preferably mounted on the golf bag for holding golf accessories such as golf balls, golf tees, and marking plates loosely placed in suitable pockets in the holder. It is further known to provide a marking plate having a laterally extending pin which is insertable into a complementary opening in a holder, or in the end of the handle of a golf club. The pin is retained in the opening by friction. It is further known to provide a magnetic pin which is affixed to a golfer's clothing or a golf bag, and a marking plate is releasably secured to the pin by magnetism. Although the aforementioned holders for marking plates operate satisfactorily, most of them suffer from the disadvantage that the holders and/or the marking plates are readily misplaced or lost, and hence are not availble when needed. As a consequence, the golfer occasionally finds himself in the predicament of needing a marking plate to mark the ball and none is available. A further disadvantage of some of the prior art holders is that a special marking plate is needed other than a simple, readily obtainable circular disc such as a coin. Also in the situation where a marking plate is secured to the end of the club handle, such plate strikes the bottom of the golf bag each time the club is placed in the bag resulting in possible dislodgement of the plate from the club handle. Another disadvantage is the necessity for the golfer to maintain visual contact with the marking plate while returning it to its holder. Applicant's improved holder for a golf ball marking plate obviates these and other disadvantages by providing a holder that is directly secured to the putter for releasably holding a marking plate, preferably in the form of a common coin such as a dime.

SUMMARY OF THE INVENTION

In accordance with a preferred embodiment of the invention, a holder for a golf ball marking plate such as a coin is disclosed comprising a body member having a first recess on one side defining a planar surface lying in a first plane for receiving the coin. The body member has plate confining walls on opposite sides of the first recess with a flexible lip on one or more of the walls lying in a second plane on one side of the first plane and spaced from the first plane a distance slightly greater than the thickness of the coin. The distance between the lips, or the lip and the opposite wall in the situation where only one lip is provided, is slightly less than the distance across or diameter of the coin whereupon the coin is releasably held in the first recess when forced therein past the lip. The body member further has a second recess on the opposite side extending the full length of the body. The second recess receives the shank of a golf putter when the holder is mounted thereon, and hence conforms to the outer periphery of the shank, which is preferably cylindrical. The body member is further provided with means for releasably securing the body member to the shank of the putter. The body member securing means preferably comprises a tape similar to a band-aid having an adhesive on one entire side in which end portions of the tape are completely covered by cover sheets leaving the adhesive on a mid-portion of the tape exposed. The tape is secured to the holder by adhering the mid-portion to the planar surface of the first recess with the covered end portions of the tape extending laterally from the body member. When it is desired to secure the holder to the shank, the cover sheets are removed, the holder placed on the shank and the tape end portions wrapped around the shank. In a modification of the invention, the walls of the holder are provided with beveled surfaces extending from their free ends to the lips for guiding the coin into register with the lips prior to insertion thereof into the first recess. In a further modification, the planar surface of the first recess is provided with a third recess for receiving the exposed mid-portion of the tape. The third recess extends from the planar surface and has a tape contacting surface lying in a third plane on the opposite side of the first plane. The depth of the third recess or spacing between the tape contacting surface and planar surface is greater than the thickness of the mid-portion of the tape whereby the coin strikes the planar surface when the coin is inserted into the first recess. The noise resulting therefrom denotes to the golfer that the coin has been properly inserted into the holder.

In another embodiment of the invention, the securing means comprises resilient fingers secured to or formed integrally with the body member, and defining a recess therebetween for receiving and holding the shank of the putter. In another embodiment, the plate securing means comprises a magnet embedded in one side of the body. In still another embodiment, the plate securing means comprises a small necked recess in one side of the body member for receiving a nipple on a marking plate, and releasably holding it by a snap fit.

One of the objects of the present invention is to provide a holder for a golf ball marking plate in which the holder is directly secured to the golf putter.

Another object of this invention is to provide a golf ball marking plate holder and golf club combination to provide access to a marking plate whenever the golf club is used.

Another object of the invention is to provide a holder for a golf ball marking plate in which the plate can be readily inserted into the holder with a minimum of visual observation and primarily by feel, and further indicates to the golfer by a slight noise that the plate has been properly inserted into the holder.

Another object of the invention is to provide a golf ball marking plate holder for a golf club that prevents dislodgement of the marking plate when the golf club is returned to the golf bag.

Another object of the invention is to provide an improved holder for a golf ball marking plate that is of simple design and construction, thoroughly reliable and efficient in operation, and economical to manufacture.

The invention and its objects and advantages will become more apparent from the detailed description of the preferred embodiments presented below.

BRIEF DESCRIPTION OF THE DRAWING

In the detailed description of the preferred embodiments of the invention presented below, reference is made to the accompanying drawing, in which.

DESCRIPTION OF THE PREFERRED EMBODIMENTS

Figure 1:
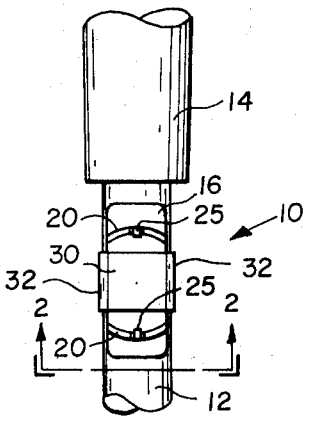
FIG. 1 is a segmental front elevational view of a golf putter to which a preferred embodiment of the holder of this invention is secured.
Figure 2:
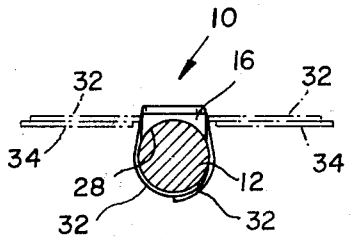
FIG. 2 is an enlarged section view taken substantially along line 2—2 of FIG. 1.
Figure 3:
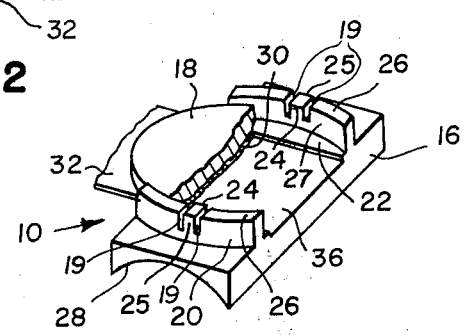
FIG. 3 is a perspective view of the marking plate holder of this invention.
Figure 4:
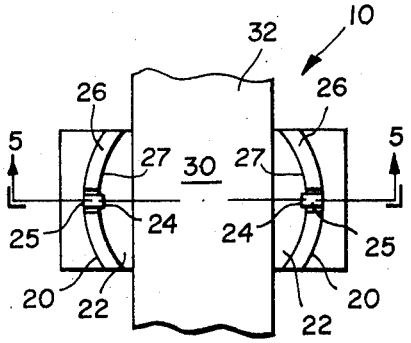
FIG. 4 is a top plan view of the holder.

With reference to FIGS. 1–5, one embodiment of a marking plate holder 10 of this invention is illustrated secured to a shank 12 of a golf club such as a putter at a point just below the handle 14. The holder 10 comprises a unitary body 16 preferably formed by a molding operation out of a plastic material such as "Delrin" (trademark). The body 16 has a plate retaining means on one side for releasably holding a plate 18 of any suitable shape, but preferably in the form of a common coin such as a dime. The width of the body and/or plate retaining means is less than the diameter of the dime to permit the dime to extend past the sides thereof (FIG. 3) in position to be easily grasped by the fingers of the golfer for insertion and removal from the holder. The dime retaining means comprises arcuately shaped walls 20 defining a first recess having a planar surface 22 lying in a first plane and engageable by one side of the coin. One or more of the walls 20 is provided with a flexible coin retaining lip 24 preferably on a flexible finger portion 25 of wall 20 (FIG. 3) formed by spaced slots 19. Each lip 24 has a lower surface 21 facing surface 22 and lying in a second plane spaced from the first plane of the planar surface 22 a distance slightly greater than the thickness of a coin. In addition, the distance between the tips 23 of lips 24, or the tip 23 of a lip and the opposite inner surface 27 of wall 20 where only one lip is provided, is slightly less than the diameter of a dime. Accordingly, when a dime 18 is pushed past the flexible, resilient lip(s) 24, the finger(s) and lip(s) retract to their original position retaining the dime in the first recess. The walls 20 are further provided with beveled surfaces 26 extending from their free ends toward lips 24 to guide a dime introduced into the holder into register with the lips. This facilitates introducing the dime 18 into the holder, and permits insertion of the dime without visual observation of the holder by the operator. The walls 20 further provide protection for the dime, and prevent dislodgement of the dime from the holder when the golf club strikes other clubs and/or the bottom of the bag when the club is returned to the bag. The opposite side of body member 16 is provided with a second recess extending throughout the length of the body, and having a surface 28 of a shape conforming to the outer peripheral surface of shank 12 of the golf putter onto which the holder 10 is mounted as best seen in FIG. 2. The body member 16 is further provided with means comprising a tape 30 for securing the body member to shank 12 of the club. The tape 20 is of any suitable type having an adhesive on one side only, in which the adhesive on the end portions 32 is covered by cover sheets 34 leaving the adhesive on the mid-portion of the tape exposed. The exposed mid-portion of the tape 30 is pressed into a third recess (FIG. 5) in the planar surface 22 of body member 16, and secured to a surface 36 thereof with the covered end portions extending laterally from the body member as illustrated by broken lines in FIG. 2. Accordingly, when it is desired to attach a holder 10 to a golf club, the cover sheets 34 are removed, the body member 16 mounted on the club shank 12 which nests in the second recess 28, and the exposed end portions 32 of tape 30 wrapped around the shank as illustrated in FIG. 2, with the adhesive surfaces adhering to shank 12.

Figure 5:
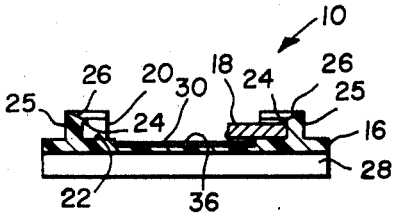
FIG. 5 is a section view taken substantially along line 5—5 of FIG. 4.

With reference to FIG. 5, the surface 36 of the third recess is illustrated as spaced from planar surface 22 a distance that is greater than the thickness of tape 30. As a result, the upper surface of the tape is slightly below the planar surface 22. Accordingly, when a coin 18 is inserted into the holder and forced past lips 24, the lower surface of the coin strikes planar surface 22 and makes a slight noise. This indicates to the golfer that coin 18 has been fully inserted into holder 10.

Figure 6:
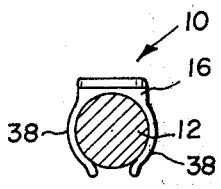
FIG. 6 is another embodiment of the holder provided with spring fingers for securing the holder to the putter.

In the modification of the holder 10 illustrated in FIG. 6, the means for securing the holder to club shank 12 comprise resilient fingers 38 preferably integrally formed with body member 16 for securing the holder to the shank when the holder is snapped thereon.

Figure 7:
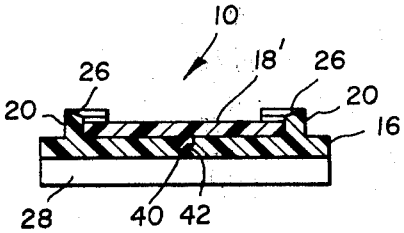
FIG. 7 is another embodiment of the invention in which the holder is provided with a recess for receiving a nipple on the marker.

In the modification of the invention illustrated in FIG. 7, the plate retaining means comprises a recess 40 in which the diameter of the neck portion of the recess is less than the diameter of the lower portion thereof, and the neck portion is flexible. The plate 18' is provided with a laterally extending nipple 42 having an enlarged head which is snapped into recess 40 for releasably holding the plate.

Figure 8:
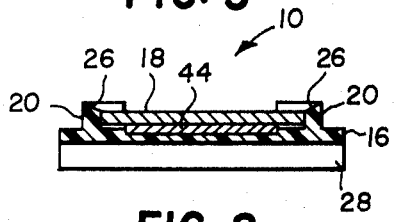
FIG. 8 is another embodiment of the invention in which the holder is provided with a magnet embedded therein to which the plate is releasably secured by magnetism.
Figure 9:
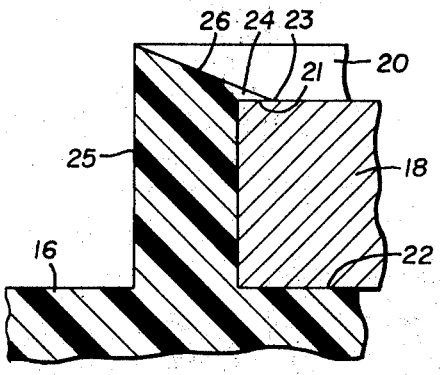
FIG. 9 is an enlarged segmental view of a portion of the holder of this invention.

In the modification of the invention illustrated in FIG. 8, the plate retaining means comprises a magnet 44 preferably imbedded in body member 16 of holder 10. A metallic plate 18 of magnetizable material is releasably held onto the holder by magnet 44. The plates 18, 18' can be of any desired shape such as circular, and are preferably of a color that contrasts with the color of the grass on the golf green.

The invention has been described in detail with particular reference to preferred embodiments, but it will be understood that variations and modifications can be effected within the spirit and scope of the invention as described.

I claim:

1. In a holder for a golf ball marking plate, the combination comprising:

a body member having a first recess on one side for receiving a marking plate, said first recess defining a planar surface lying in a first plane;

said body member having first and second walls on opposite sides of said first recess and substantially perpendicular to said planar surface, the corresponding end portions of said walls being spaced apart a distance less than the distance across the plate with at least one of said first and second walls having a flexible lip with a portion thereof projecting laterally from said one wall, said lip portion having a surface lying in a second plane on one side of and substantially parallel to said first plane and spaced from said first plane a distance slightly greater than the thickness of the plate, said lip portion further being spaced from the other of said first and second walls a distance slightly less than the distance across a corresponding part of the plate whereby the plate is releasably held in said first recess when forced therein past said lip portion; and said body member further having a second recess on the opposite side extending the full length of said body member.

2. The invention according to claim 1 wherein said other of said first and second walls has a flexible lip, and said second recess defines a surface of arcuate cross section.

3. The invention according to claim 1 wherein said other of said first and second walls has a flexible lip, and said second recess defines a semi-cylindrical surface.

4. The invention according to claim 1 wherein said other of said first and second walls has a flexible lip, and said walls are provided with means extending from the free end thereof to said lips for guiding the plate into register with said lips prior to insertion into said first recess.

5. The invention according to claim 4 wherein said guiding means comprises beveled surfaces.

6. The invention according to claim 1 wherein said second recess receives a support such as a shank of a golf club when said body member is mounted thereon, and said body member is further provided with means for releasably securing said holder to the shank.

7. The invention according to claim 6 wherein said holder securing means comprises spring fingers encircling the shank.

8. In a holder for a golf ball marking plate, the combination comprising:

a body member;

holding means on one side of said body member for releasably holding a marking plate, said holding means comprising a first recess on one side of said body member for receiving the marking plate, said first recess defining a planar surface lying in a first plane, said body member having first and second walls on opposite sides of said first recess and substantially perpendicular to said planar surface, the corresponding end portions of said walls being spaced apart a distance less than the distance across the plate, at least one of said first and second walls having a flexible lip with a portion thereof projecting laterally from said one wall, said lip portion having a surface lying in a second plane on one side of and substantially parallel to said first plane and spaced from said first plane a distance slightly greater than the thickness of the plate, said lip portion further being spaced from the other of said first and second walls a distance slightly less than the distance across a corresponding part of the plate whereby the plate is releasably held in the first recess when forced therein past said lip portion; and means on said body member for securing said body member to a golf club.

9. In a holder for a golf ball marking plate, the combination comprising:

a body member having a first recess on one side for receiving a marking plate, said first recess defining a planar surface lying in a first plane;

said body member having first and second walls on opposite sides of said first recess and substantially perpendicular to said planar surface with at least one of said first and second walls having a flexible lip with a portion thereof projecting laterally from said one wall, said lip portion having a surface lying in a second plane on one side of and substantially parallel to said first plane and spaced from said first plane a distance slightly greater than the thickness of the plate, said lip portion further being spaced from the other of said first and second walls a distance slightly less than the distance across a corresponding part of the plate whereby the plate is releasably held in said first recess when forced therein past said lip portion;

said body member further having a second recess on the opposite side extending the full length of said body member for receiving a support such as a shank of a golf club when said body member is mounted thereon; and said body member further being provided with means for releasably securing said holder to the shank;

said holder securing means comprising a tape having an adhesive surface on one side in which the adhesive surface on end portions of said tape is covered by cover sheets and the adhesive surface on a mid-portion of the tape is exposed and secured to said planar surface with the covered end portions of said tape extending laterally from said body member.

10. In a holder for a golf ball marking plate, the combination comprising:

a body member having a first recess on one side for receiving a marking plate, said first recess defining a planar surface lying in a first plane;

said body member having first and second walls on opposite sides of said first recess and substantially perpendicular to said planar surface with at least one of said first and second walls having a flexible lip with a portion thereof projecting laterally from said one wall, said lip portion having a surface lying in a second plane on one side of and substantially parallel to said first plane and spaced from said first plane a distance slightly greater than the thickness of the plate, said lip portion further being spaced from the other of said first and second walls a distance slightly less than the distance across a corresponding part of the plate whereby the plate is releasably held in said first recess when forced therein past said lip portion;

said body member further having a second recess on the opposite side extending the full length of said body member, said second recess adapted to receive a support such as a shank of a golf club when said body member is mounted thereon;

said planar surface of said first recess is provided with a third recess extending from said planar surface and defining a flat surface lying in a third plane on the opposite side of said first plane; and said body member is further provided with means mounted in said third recess and secured to said body member for releasably securing said holder to the shank.

11. The invention according to claim 10 wherein said means mounted in said third recess comprises a tape having an adhesive surface on one side in which the adhesive surface on end portions of said tape is covered by cover sheets and the adhesive surface on a mid-portion of the tape is exposed and secured to said flat surface with the covered ends of said tape extending laterally from said body member.

12. The invention according to claim 11 wherein the space between said flat surface and said planar surface is greater than the thickness of said tape whereby said plate strikes said planar surface when said plate is inserted into said first recess.

* * * * *